US005444185A

United States Patent [19]

Tanaka

[11] Patent Number: 5,444,185

[45] Date of Patent: Aug. 22, 1995

[54] SLEEVE FOR INSULATING ELECTRIC TERMINAL

[75] Inventor: Shinzo Tanaka, Tokyo, Japan

[73] Assignee: Tokyo Dipp Co., Ltd., Tokyo, Japan

[21] Appl. No.: 121,770

[22] Filed: Sep. 15, 1993

[30] Foreign Application Priority Data

Sep. 28, 1992 [JP] Japan ..... 4-077137 U

[51] Int. Cl.[6] ..... H01B 17/58

[52] U.S. Cl. ..... 174/138 F; 174/135; 174/74 A

[58] Field of Search ..... 174/138 F, 135, 83, 174/74 A, 84 R

[56] References Cited

U.S. PATENT DOCUMENTS 2,369,735 2/1945 Heit ..... 174/74 A

FOREIGN PATENT DOCUMENTS 1388736 3/1975 United Kingdom ..... 174/135

1070632 1/1984 U.S.S.R. ..... 174/84 R

OTHER PUBLICATIONS

Burek, "Insulating Jacket for a Terminal on a Wire End", Apr. 1966, p. 1, Western Electric, 174–138F.

*Primary Examiner*—Leo P. Picard

*Assistant Examiner*—Hyung S. Sough

*Attorney, Agent, or Firm*—Burgess, Ryan & Wayne

[57] ABSTRACT

An insulating sleeve of elastic plastic for encasing an electric terminal having a front part having a hole to accommodate the plug end of the terminal, the width of the hole being larger than the height thereof, and a rear part having a hole whose height is large enough to accommodate the widest part of the terminal and whose width is large enough to pass the height of the terminal but not large enough to pass the widest part of the terminal, and an intermediate part having a hole whose diameter is large enough to permit the terminal to be rotated about the longitudinal axis thereof. The terminal that can be inserted and extracted through the rear part of the sleeve remains firmly locked in the sleeve during service.

7 Claims, 3 Drawing Sheets

SLEEVE FOR INSULATING ELECTRIC TERMINAL

BACKGROUND OF THE INVENTION

This invention relates to a sleeve for encasing a solderless terminal 2 connected to an electric part and a lead 3 therein and having a socket-frame 21 designed to receive a male terminal that is plugged therein as shown at (a) in FIG. 1 (which shows a lead 3 and a solderless terminal 2 that are unbranched and, therefore, adapted to pass only an incoming or an outgoing current) or a terminal 2 having no socket-frame as shown at (b) in FIG. 1 (which shows a lead 3 and a terminal 2 that are branched and, therefore, adapted to pass both incoming and outgoing currents).

Conventional terminal-insulating sleeves are shaped substantially analogous to the contour of terminals encased therein as shown in FIG. 2 (which shows a sleeve fitted over a solderless terminal of the type shown at (a) in FIG. 1).

Terminals of both types shown at (a) and (b) in FIG. 1 usually consist of the main part whose width is larger than the thickness thereof, with the end thereof connected to a lead 3 being either tapered or constricted. Insulating sleeves are shaped substantially similar to such terminals.

When inserting terminals into conventional sleeves, accordingly, a lead 3 has been first inserted from the front end of an insulating sleeve 1, with a terminal connected to the lead 3 inserted thereafter, as shown in FIG. 3 (which also shows a solderless terminal of the type shown at (a) in FIG. 1).

However, inserting a terminal into a sleeve according to this method has not been simple when a lead 3 is very long.

The object of this invention is to provide a terminal-insulating sleeve that obviates the aforementioned shortcoming in the conventional sleeves by allowing the insertion of a terminal from the rear end of the sleeve, with provision made to keep the inserted terminal securely in position.

SUMMARY OF THE INVENTION

To achieve the object described above, an insulating sleeve of elastic plastic to encase a terminal according to this invention comprises a front part to accommodate the plug end of the terminal whose inner space measures larger widthwise than heightwise, a rear part having an inner space whose height is large enough to accommodate the widest part of the terminal and whose width is large enough to accommodate the thickness of the terminal but not large enough to accommodate the widest part thereof, and an intermediate part having a large enough inner space to permit the terminal to be rotated about the longitudinal axis thereof.

DETAILED DESCRIPTION OF THE INVENTION

The operational principle of this invention is described below.

Figure 1A:
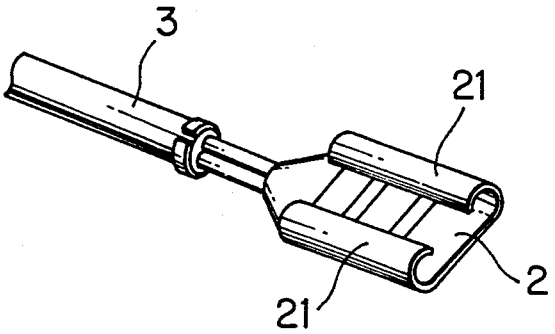
FIG. 1(a) (PRIOR ART)
FIGS. 1(*a*) and 1(*b*) perspectively show a solderless terminal and another terminal.
Figure 1B:
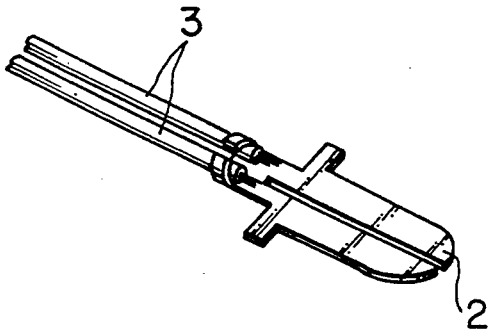
FIG. 1(b) (PRIOR ART)
Figure 2:
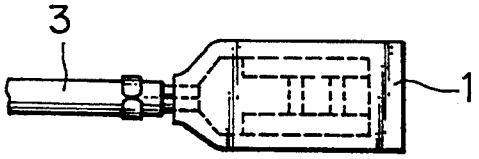
FIG. 2 (PRIOR ART)
FIG. 2 is a front view of a conventional insulating sleeve containing a terminal therein.
Figure 3:
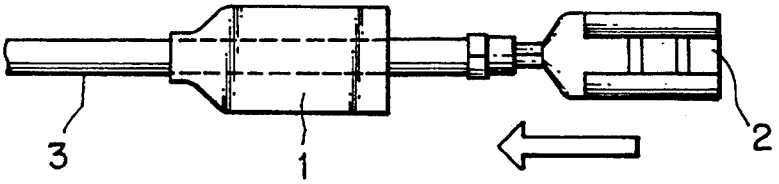
FIG. 3 (PRIOR ART)
FIG. 3 schematically illustrates how a terminal is inserted into an insulating sleeve.

To insert a terminal 2 into an insulating sleeve 1, the plug end 20 of the terminal is first passed through a vertical slit in the rear end 13 of the insulating sleeve 1. (The terminal 2 shown at (a), (b) and (c) of FIG. 4 is of the type shown in FIG. 1(*b*), with the arrow indicating the direction of insertion.)

The opening in the rear end 13 of the insulating sleeve 1 is designed to have a large enough height to accommodate the width of the plug end 20 of the terminal 2. However, the height of the opening in the rear end 13 does not always need to be larger than the width of the plug end 20.

Even if the height of the opening in the rear end 13 is slightly smaller than the width of the plug end 20, the pushing force exerted on the terminal expands the opening in the rear end 13 of the insulating sleeve 1 that is made of elastic plastic to permit the plug end 20 to be passed therethrough. (Of course, the opening in the rear end 13 of the insulating sleeve 1 may be designed to have a height larger than the width of the plug end 20 of the terminal.)

Figure 4A:
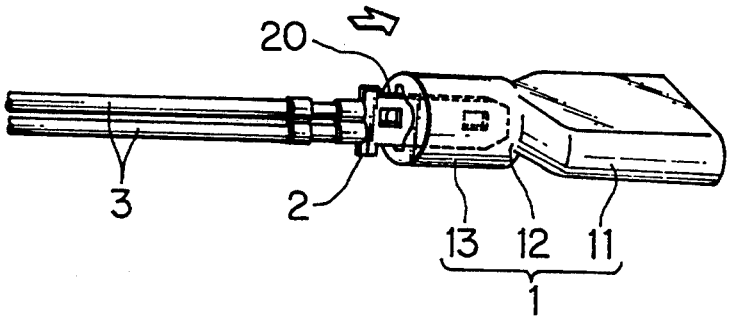
FIGS. 4(*a*), 4(*b*) and 4(*c*) perspectively show the steps of inserting a terminal into an insulating sleeve of this invention.
Figure 4B:
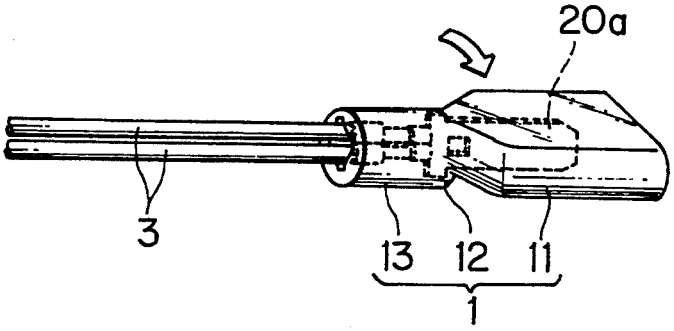
Figure 4C:
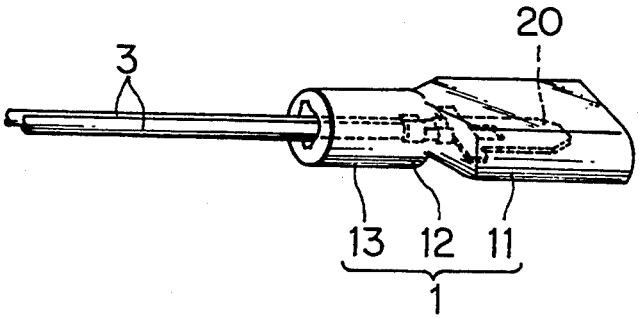

Secondly, the plug end 20 of the terminal 2 is turned about the longitudinal axis thereof in the intermediate part 12 of the insulating sleeve 1 (as indicated by the arrow in FIG. 4(*b*)) so that the plug end 20 of the terminal 2 is in a horizontal plane parallel to the insulating sleeve 1.

The opening in the intermediate part 12 does not always need to be larger than the widest part of the plug end 20 for the same reason as that mentioned before.

Even if the diameter of the opening in the intermediate part 12 is substantially equal to or slightly smaller than the widest part of the plug end 20, the insulating sleeve of plastic is elastic enough to allow the expansion of the opening therein to such an extent as to permit the rotation of the terminal described above. (Of course, the diameter of the opening in the intermediate part 12 may be made larger than the widest part of the plug end 20.)

Thirdly, the plug end 20 of the terminal 2 is inserted into the front part 11 of the insulating sleeve 1 as shown at (c) in FIG. 4.

The opening in the front part 11 has a width larger than the height thereof so as to permit the plug end 20 of the terminal 2 to be accommodated therein.

Here again, the width and height of the opening in the front part 11 do not always need to be larger than the width and height of the terminal. Even if the width and height of the opening in the front part 11 are substantially equal to or slightly smaller than those of the plug end 20 of the terminal, the elastic insulating sleeve 1 expands adequately to permit the insertion of the plug end 20. (Of course, the opening in the front part 11 of the insulating sleeve 1 may have a width and height larger than those of the plug end 20 of the terminal 2.)

As described above, the insulating sleeve 1 comprises the rear part 13 that has an opening high enough to accommodate the width of the plug end 20 of the terminal 2, the intermediate part 12 having a large enough opening to permit the rotation of the plug end 20 therein, and the front part 11 having an opening whose width is large enough to accommodate the width of the terminal 2. The openings in the aforementioned parts of the insulating sleeve 1 do not always need to be larger than the width of the terminal 2, but may be substantially equal to or slightly smaller than that.

However, the openings in the insulating sleeve 1 must not be reduced beyond the limit where the terminal 2 can no longer be inserted by taking advantage of the elasticity of the insulating sleeve. If the openings in the insulating sleeve 1 are made smaller than the width of the terminal 2, therefore, the size difference therebetween must be kept within the limit in which advantage can be taken of the elasticity of the insulating sleeve.

Figure 5:
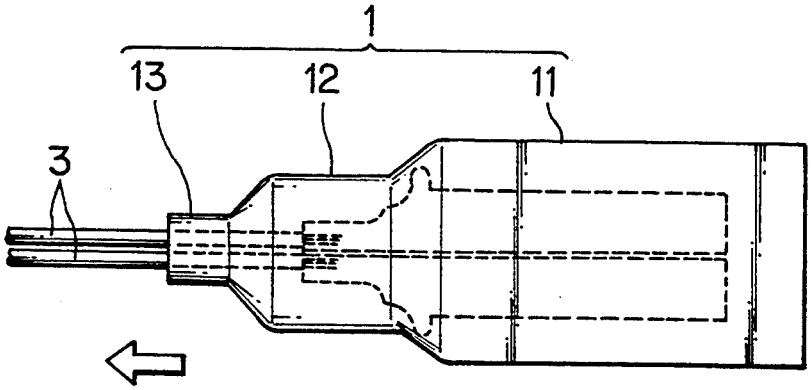
FIG. 5 is a top view of an insulating sleeve that does not permit the terminal once inserted to be withdrawn through an opening at the rear end thereof.

Once fit in the insulating sleeve 1 as described above, the terminal 2 does not come off the insulating sleeve 1 even when pulled backward as shown in FIG. 5 because the width of the opening in the rear part of the insulating sleeve 1 is small enough to prevent the passage of the plug end 20 of the terminal 2 in the horizontal position. (The arrow in FIG. 5 shows the direction in which the terminal is pulled backward.)

As the diameter of the opening in the intermediate part shown in FIG. 5 is slightly smaller than the width of the plug end 20 of the terminal, the plug end 20 of the terminal 2 pulled backward is stopped by the intermediate part whose diameter is designed to be slightly smaller than the width of the plug end 20. If the diameter of the intermediate part is equal to or larger than the width of the plug end 20 of the terminal 2, the plug end 20 passes through the intermediate part 12 but is stopped by the rear part 13 thereof, thereby remaining locked inside the insulating sleeve 1.

The terminal 2 can be disengaged from the insulating sleeve 1 by reversing the process described before; i.e., by pulling the terminal 2 to the intermediate part of the insulating sleeve 1, turning the terminal 2 there to align the width of the plug end 20 of the terminal 2 with the vertical slit in the rear part 13 of the insulating sleeve 1, and pulling the terminal 2 backward therethrough.

DESCRIPTION OF THE PREFERRED EMBODIMENTS

Figure 6A:
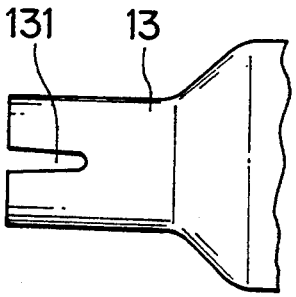
FIGS. 6(*a*) and 6(*b*) show a top view and a cross-sectional side elevation of the rear part of a first insulating sleeve according to this invention.
Figure 6B:
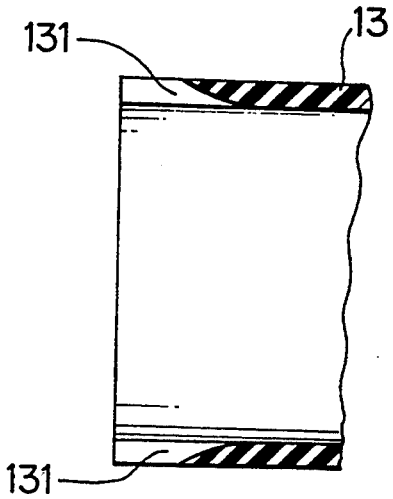

A first preferred embodiment of this invention has a slit 131 at each of the top and bottom of the rear part 13 of the insulating sleeve 1 as shown at (*a*) and (*b*) in FIG. 6.

Forcing the terminal 2 into the insulating sleeve 1 whose height is slightly smaller than the width of the terminal 2 by vertically expanding the sleeve 1 by taking advantage of the elasticity thereof not only involves some complexity and necessitates some force. The slits 131 facilitate the initial fitting of the terminal 2 in position and the subsequent expansion of the insulating sleeve and further insertion of the terminal 2.

Figure 7A:
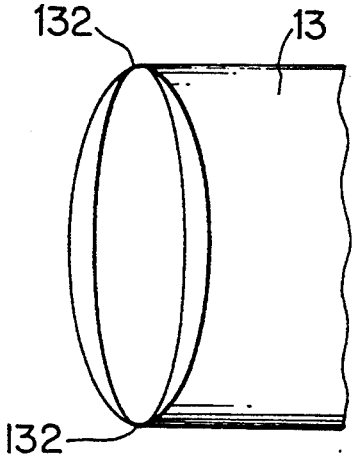
FIGS. 7(*a*) and 7(*b*) show a perspective view and a cross-sectional side elevation of the rear part of a second insulating sleeve according to this invention.
Figure 7B:
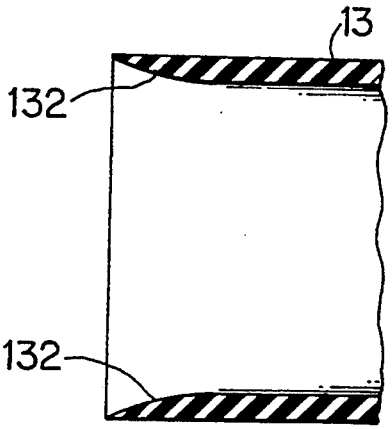

A second preferred embodiment has an outwardly tapered end 132, instead of the slit 131 in the first preferred embodiment, at the top and bottom of the rear part 13 of the insulating sleeve 1 as shown at (*a*) and (*b*) in FIG. 7.

The tapered ends 132, with the thickness thereof gradually increasing forward from the rearmost end, facilitate the initial fitting of the terminal 2 in the vertical slit in the rear part 13 and the subsequent expansion of the insulating sleeve 1 and further insertion of the terminal 2.

As is obvious from the above, the insulating sleeves of this invention permit inserting the front end of a terminal directly into the rear end thereof while eliminating the cumbersome steps of first inserting a lead from the front end of thereof and then fitting a terminal connected to the lead.

Also, the lead can be directly detached from the insulating sleeve.

Besides, the terminal once inserted in the insulating sleeve does not come off during service.

Thus, the insulating sleeves according to this invention permit a terminal to be inserted therein and taken out therefrom with much greater ease than the conventional insulating sleeves.

What is claimed is:

1. An insulating sleeve of elastic plastic for encasing an electric terminal which can be inserted through a rear part of the sleeve, said terminal having a plug end of a non-circular cross-section with a width, a height and a widest part, with the width being greater than the height thereof, said sleeve comprising:

a front part having an open area therein of a non-circular cross-section to accommodate the plug end of the terminal, the open area having a width and a height, with the width of the open area of the front part being greater than the height of the open area of the front part, a rear part having an open area therein of a non-circular cross-section, with a height large enough to accommodate the widest part of the terminal and a width large enough to pass the height of the terminal but not large enough to pass the widest part of the terminal, and a circular intermediate part having an open area therein with dimensions large enough to permit relative rotation of the plug end of the terminal and the sleeve about a longitudinal axis thereof.

2. The sleeve according to claim 1, in which the open area in the rear part has a height and width slightly smaller than the width and height of the terminal to be inserted.

3. The sleeve according to claim 1, in which the open area in the rear part has a height and width substantially equal to the width and height of the terminal to be inserted.

4. The sleeve according to claim 1, in which the open area in the intermediate part has a diameter slightly smaller than the width of the terminal to be inserted.

5. The sleeve according to claim 1, in which the open area in the intermediate part has a diameter substantially equal to the width of the terminal to be inserted.

6. The sleeve according to claim 1, in which a slit is provided at a top and bottom of the rear part.

7. The sleeve according to claim 1, in which a tapered end is provided at a top and bottom of the rear part.

* * * * *